US006674406B1

(12) United States Patent
Tonn

(10) Patent No.: US 6,674,406 B1
(45) Date of Patent: Jan. 6, 2004

(54) MICROSTRIP PATCH ANTENNA WITH PROGRESSIVE SLOT LOADING

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/267,593

(22) Filed: Oct. 8, 2002

(51) Int. Cl.[7] ..... H01Q 1/38; H01Q 13/10
(52) U.S. Cl. ..... 343/700 MS; 343/770
(58) Field of Search ..... 343/700 MS, 767, 343/770, 792.5

(56) References Cited

U.S. PATENT DOCUMENTS 4,313,120 A * 1/1982 Westerman ..... 343/771
4,518,967 A * 5/1985 Westerman ..... 343/771
5,400,042 A * 3/1995 Tulintseff ..... 343/727
5,977,924 A * 11/1999 Takei et al. ..... 343/770
6,025,812 A * 2/2000 Gabriel et al. ..... 343/797
6,388,621 B1 * 5/2002 Lynch ..... 343/700 MS

* cited by examiner

*Primary Examiner*—Tan Ho
(74) *Attorney, Agent, or Firm*—James M. Kasischke; Michael F. Oglo; Jean-Paul A. Nasser

(57) ABSTRACT

A microstrip patch antenna with progressive slot loading is provided. A rectangular patch of electrically conductive material has a plurality of slots formed therein with each slot having its center aligned with the centerline of the patch's long dimension. Each slot further has its longitudinal axis perpendicular to the centerline. The slots are arranged in an order starting at a position n=1 that is furthest from the patch's feedpoint so that, for an n-th slot, the inequalities $L_n > L_{n+1}$ and $W_n < W_{n+1}$ are always satisfied. In general, the length decreases linearly with each successive slot while the width increases exponentially with each successive slot.

11 Claims, 1 Drawing Sheet

MICROSTRIP PATCH ANTENNA WITH PROGRESSIVE SLOT LOADING

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to patch antennas, and more particularly to a microstrip patch antenna having a plurality of parallel slots formed therein to increase the bandwidth performance of the antenna.

(2) Description of the Prior Art

An ordinary microstrip patch antenna consists of a rectangular metallic "patch" that is printed on top of a grounded slab of dielectric material. It is a very useful antenna, but suffers from limited bandwidth as a result of its resonant properties. Bandwidth of these antennas is typically limited to 2–4% of the antenna's center frequency.

SUMMARY OF THE INVENTION

Accordingly, it is an object of the present invention to provide a patch antenna having improved bandwidth characteristics.

Another object of the present invention is to provide a rectangular microstrip patch antenna having improved bandwidth characteristics for a variety of antenna applications.

Other objects and advantages of the present invention will become more obvious hereinafter in the specification and drawings.

In accordance with the present invention, a patch antenna with progressive slot loading is based on a rectangular patch of electrically conductive material with long and short dimensions. A centerline of the patch is defined along the long dimension. The patch has a feedpoint located at one end of the patch at its centerline. A plurality of slots are formed in the patch with each slot having its center aligned with the centerline of the patch. Further, each slot has its longitudinal axis perpendicular to the centerline of the patch. Each slot has a unique length $L_n$ and width $W_n$. The slots are arranged in an order starting at a position n=1 that is furthest from the patch's feedpoint so that, for an n-th slot, the inequalities $L_n>L_{n+1}$ and $W_n<W_{n+1}$ are always satisfied. In general, the length decreases linearly with each successive slot while the width increases exponentially with each successive slot.

BRIEF DESCRIPTION OF THE DRAWINGS

Other objects, features and advantages of the present invention will become apparent upon reference to the following description of the preferred embodiments and to the drawings, where corresponding reference characters indicate corresponding parts throughout the several views of the drawings and wherein.

DESCRIPTION OF THE PREFERRED EMBODIMENT(S)

Figure 1:
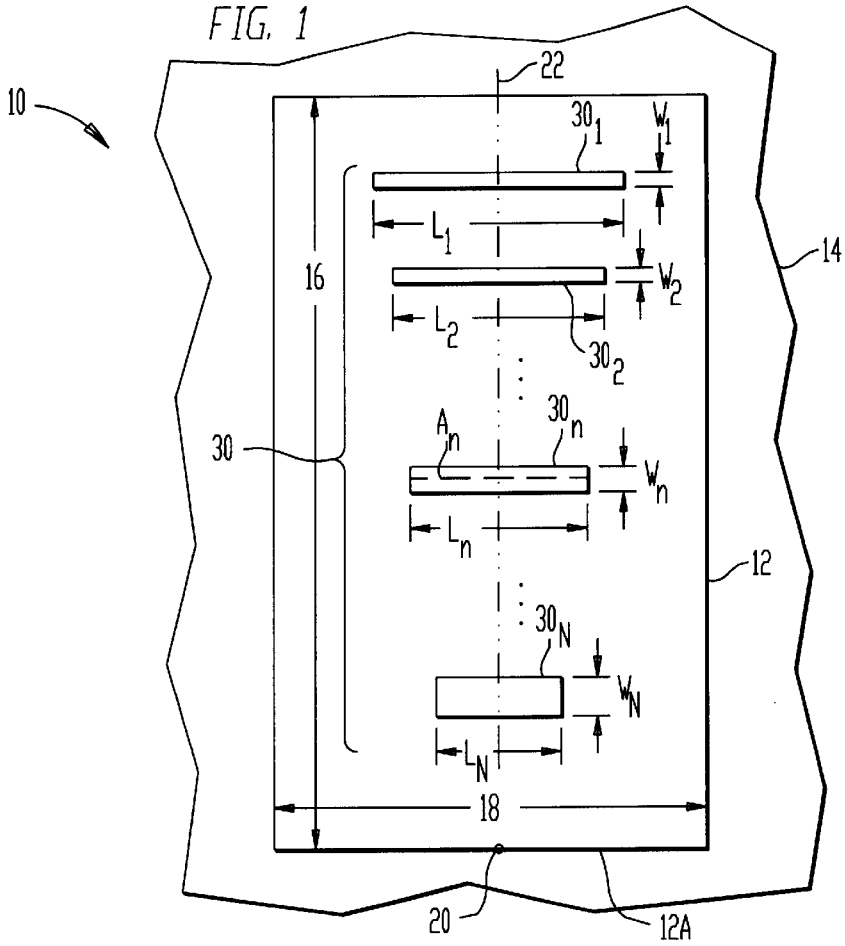
FIG. 1 is a schematic view of a patch antenna having progressive slot loading in accordance with the present invention.

Referring now to the drawings, and more particularly to FIG. 1, a schematic view of a microstrip patch antenna in accordance with the present invention is shown and is referenced generally by numeral 10. Typically, a rectangular patch 12 of electrically conductive material is provided (e.g., deposited, printed, etc.) on a base 14 of grounded dielectric material as is well known in the art. Rectangular patch 12 is defined by a long dimension referenced by arrow 16 and a short dimension referenced by arrow 18. As is known in the art, the rectangular nature of patch 12 defines a dominant mode of current distribution that runs along long dimension 16. To take advantage of this fact, patch 12 is fed with an electrical input at one end thereof along short dimension 18. More specifically, for an even current distribution, patch 12 is fed with its electrical input at a feedpoint 20 that is centered at one end 12A of patch 12 along short dimension 18. In other words, feedpoint 20 is located along a centerline 22 of patch 12 that extends along long dimension 16. Feedpoint 20 can be fed by any known feedline structure such as a conductive strip, a coaxial line, etc., the choice of which is not a limitation of the present invention.

In accordance with the present invention, patch 12 has a plurality of slots 30 (i.e., slots $\mathbf{30}_1$, $\mathbf{30}_2$, . . . , $\mathbf{30}_n$, . . . , $\mathbf{30}_N$) cut or otherwise formed therein. Each of slots 30 is a hole formed all the way through patch 12, but does not extend into dielectric base 14. Slots 30 can be formed when patch 12 is formed or after in accordance with any of a variety of well known fabrication techniques. In general, each of slots 30 has a length L that is substantially greater than its width W where length L is perpendicular to centerline 22 and width W is parallel to center line 22. Typically, each of slots 30 will be rectangular or approximately rectangular depending on the precision of the particular fabrication technique. However, in all cases, each of slots 30 is centered on centerline 22 with its longitudinal axis A (i.e., the axis extending along length L) of each slot 30 being perpendicular to centerline 22. For clarity of illustration, the slot's longitudinal axis $A_n$ is only illustrated for slot $\mathbf{30}_n$.

For the present invention, each of slots 30 has a unique length $L_n$ and width $W_n$ where the index n is referenced to a starting position (i.e., n=1) that is furthest from feedpoint 20. In general, as slots get closer to feedpoint 20, their length decreases while their width increases so that the inequalities $L_n>L_{n+1}$ and $W_n<W_{n+1}$ will always be satisfied. On-center spacing between adjacent slots is approximately equal and can be used to fine tune antenna performance.

Testing of the present invention yielded good bandwidth performance when adjacent lengths $L_n$ decreased linearly from n=1 to N while widths $W_n$ increased exponentially from n=1 to N. By way of illustrative example, an exponential width relationship that yields good bandwidth performance is $$W_{n+1}=e^{1/4}W_n \tag{1}$$

where the starting position of n=1 generally has its width $W_1$ defined by the user.

Figure 2:
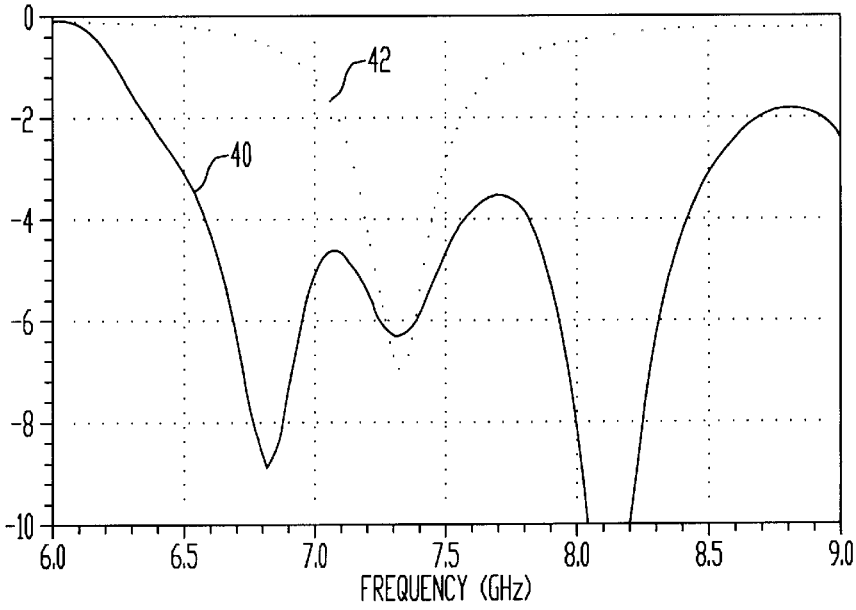
FIG. 2 is a graph comparing bandwidth performance of a conventional rectangular patch antenna with that of an embodiment of the progressive slot loaded patch antenna of the present invention.

A tested example of the present invention was based on a 31 millimeter (mm) by 19 mm rectangular patch having a first slot (i.e., slot $\mathbf{30}_1$) that was 0.5 mm wide by 15 mm long. Four additional slots were formed with adjacent slots being decreased by 2 mm in length and increased in width predicated on equation (1). Bandwidth performance of this progressive slot loaded antenna is illustrated by curve 40 in FIG. 2. This graph represents the magnitude of the reflection coefficient looking into the input port of the antenna. Dashed-line curve 42 represents the bandwidth performance of a conventional 31 mm by 19 mm patch with no slots. A lower value on this graph means more energy is getting into the antenna. From this, it is clear that bandwidth performance is substantially improved by the progressive slot loading of the present invention.

The advantages of the present invention are numerous. Bandwidth performance is greatly improved simply by forming slots in a patch antenna. The principles set forth herein can be adapted/scaled to a variety of specific applications and bandwidth requirements simply by scaling the dimensions of the slots, changing the number of slots used, and/or changing the dimensions of the patch.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A microstrip patch antenna, comprising:

a rectangular patch of electrically conductive material, said patch having a long dimension and a short dimension with a centerline of said patch being defined along said long dimension, said patch having a feedpoint located at one end thereof at said centerline; and a plurality of slots formed in said patch, each of said plurality of slots having a center aligned with said centerline, each of said plurality of slots having a longitudinal axis that is perpendicular to said centerline, each of said plurality of slots having a unique length $L_n$ and width $W_n$, said plurality of slots being arranged in an order starting at a position n=1 that is furthest from said feedpoint wherein, for an n-th slot from said plurality of slots, $L_n>L_{n+1}$ and $W_n<W_{n+1}$.

2. A microstrip patch antenna as in claim 1 wherein each of said plurality of slots is approximately rectangular.

3. A microstrip patch antenna as in claim 1 wherein spacing between centers of adjacent ones of said plurality of slots is approximately equal.

4. A microstrip patch antenna as in claim 1 wherein said length changes linearly in said order.

5. A microstrip patch antenna as in claim 1 wherein said width changes exponentially in said order.

6. A microstrip patch antenna, comprising:

a rectangular patch of electrically conductive material, said patch having a long dimension and a short dimension with a centerline of said patch being defined along said long dimension, said patch having a feedpoint located at one end thereof at said centerline; and a plurality of slots formed in said patch, each of said plurality of slots having a center aligned with said centerline, each of said plurality of slots having a longitudinal axis that is perpendicular to said centerline, each of said plurality of slots having a unique length $L_n$ and width $W_n$, said plurality of slots being arranged in an order starting at a position n=1 that is furthest from said feedpoint wherein, for an n-th slot from said plurality of slots, $L_n>L_{n+1}$ and $W_{n+1}=e^{1/4}W_n$, and wherein said width $W_n$ at said position n=1 is known.

7. A microstrip patch antenna as in claim 6 wherein each of said plurality of slots is approximately rectangular.

8. A microstrip-patch antenna as in claim 6 wherein spacing between centers of adjacent ones of said plurality of slots is approximately equal.

9. A microstrip patch antenna as in claim 6 wherein said length changes linearly in said order.

10. A microstrip patch antenna, comprising:

a rectangular patch of electrically conductive material, said patch having a long dimension and a short dimension with a centerline of said patch being defined along said long dimension, said patch having a feedpoint located at one end thereof at said centerline; and a plurality of slots formed in said patch, each of said plurality of slots being approximately rectangular and having a center aligned with said centerline, each of said plurality of slots having a longitudinal axis that is perpendicular to said centerline with spacing between centers of adjacent ones of said plurality of slots being approximately equal, each of said plurality of slots having a unique length $L_n$ and width $W_n$, said plurality of slots being arranged in an order starting at a position n=1 that is furthest from said feedpoint wherein, for an n-th slot from said plurality of slots, $L_n>L_{n+1}$ and $W_{n+1}=e^{1/4}W_n$, and wherein said width $W_n$ at said position n=1 is known.

11. A microstrip patch antenna as in claim 10 wherein said length changes linearly in said order.

* * * * *